US005186430A

United States Patent [19]

Ellithorpe

[11] Patent Number: 5,186,430

[45] Date of Patent: Feb. 16, 1993

[54] ADJUSTABLE COLUMN CAP OR BASE

[76] Inventor: Richard C. Ellithorpe, 10,7139 - 40th St. S.E., Calgary, Canada, T2C 2H7

[21] Appl. No.: 862,140

[22] Filed: Apr. 2, 1992

[30] Foreign Application Priority Data

Feb. 12, 1992 [CA] Canada ..... 2061072

[51] Int. Cl.[5] ..... E04G 25/00

[52] U.S. Cl. ..... 248/354.3; 52/126.1; 52/243.1; 405/288

[58] Field of Search ..... 248/354.1, 354.3, 354.4, 248/219.2, 218.4; 52/243.1, 126.1, 126.3, 126.4; 405/288, 7, 290

[56] References Cited

U.S. PATENT DOCUMENTS

| | | | |
|---|---|---|---|
| 2,584,015 | 1/1952 | Hawes | 248/354.4 |
| 3,027,140 | 4/1971 | Holzbach . | |
| 4,345,734 | 8/1982 | Studinger | 248/354.4 X |
| 4,684,097 | 8/1987 | Cox | 248/354.3 |
| 4,870,789 | 10/1989 | Clark et al. | 52/126.3 X |
| 5,056,750 | 10/1991 | Ellithorpe | 248/354.3 |

FOREIGN PATENT DOCUMENTS

| | | |
|---|---|---|
| 472754 | 9/1946 | Canada . |
| 868225 | 4/1971 | Canada . |

*Primary Examiner*—Ramon O. Ramirez

*Attorney, Agent, or Firm*—Lowe, Price, LeBlanc & Becker

[57] ABSTRACT

An adjustable load-bearing apparatus capable of being operatively disposed on the end of an elongate structural member having a substantially fixed length so as to produce a structural member having an adjustable length. The apparatus includes a saddle for receiving a load-carrying beam, at least two adjustment screw members fixedly attached to the saddle, and respective nuts which bear on a bearing surface of a cross-bar disposed on a bearing plate. A guide sleeve depending from the saddle and slidable longitudinally along a portion of the elonate structural member provides moment coupling between the saddle and the elongate structural member, without subjecting the adjusting screws or nuts to bending moments.

12 Claims, 2 Drawing Sheets

ADJUSTABLE COLUMN CAP OR BASE

FIELD OF THE INVENTION

This invention relates to load bearing support columns, and in particular to an adjustable column cap or base adapted to be fitted onto the end of a fixed-length column so as to form an adjustable column.

BACKGROUND TO THE INVENTION

Adjustable support posts or columns are well known in the art. Typically, conventional support columns, such as lifting jacks for lifting and supporting of various structures employ a single, threaded support rod disposed in a main column. Many of these assemblies comprise a main column composed of two or more telescoping elements which can be extended and locked at predetermined intervals, such that the column can be adjusted to a length which is slightly shorter than that which is actually required. The threaded support rod, which may either engage an internal screw in the main column or an adjusting nut which bears on the top of the column, is then extended as required to support and/or raise the structure in question.

In many situations, the main column will be extended and locked into a position, and thereafter will not be further adjusted. The adjusting screw therefore constitutes the primary height adjusting means, while the main column remains locked at one length. Typically, however, adjustable columns are made as an integrated unit. Thus one is forced to purchase a large (and in some cases complex) adjustable column, even if the adjustment capabilities of the main column are not to be used. This unnecessarily increases the cost incurred by the user in order to obtain an adjustable column.

Furthermore, because the main column typically includes substantially rigid telescoping elements, it is not possible to employ the column within a space which is shorter than the shortest length (or substantially longer than the maximum extended length) of the main column. This means that one is forced to first measure the height of the location in which the column is to be placed, obtain a column having an appropriate length, and then install the column. This is a time consuming and laborious process, and, because the column almost invariably has a greater range of adjustment than is actually required, unnecessarily expensive. Furthermore, it is necessary for suppliers to stock adjustable columns having various sizes and extension capabilities, which results in increased storage costs, which are invariably passed on to the user.

U.S. Pat. No. 3,027,140 discloses an adjustable element which is adapted to be quickly and removably fitted to a fixed length column. The disclosed adjustable element comprises an adjusting screw and nut, a bearing plate, and a base plate. The adjustable element is intended to be used in conjunction with a column or post which is obtained separately, and cut approximately to length, by the user, on site.

This overcomes many of the above-stated problems related to adjustable columns. However, in a case where the column is made of wood, a hole must be bored into the end of the post in order to receive the adjusting screw. This hole must be carefully aligned with the central axis of the post, and must be properly sized so that the screw can slide within the hole, while being substantially prevented from rotation due to off-centre loading. Thus satisfactory on-site fabrication of the adjustable column is dependent on the skill of the builder, and may require special tools, thereby adding to the cost of installation of the post.

When the column is made using a metal pipe, it is necessary to employ spacer elements between the adjusting screw and the interior of the pipe. These adjusting members are intended to substantially prevent rotation of the adjusting screw due to off-centre loading. However, the requirement for purchasing spacer elements increases the cost of the column, and places a restriction on the size of the pipes which can be satisfactorily used.

SUMMARY OF THE INVENTION

It is an object of the present invention to provide an adjustable element which is adapted to be used in conjunction with a substantially fixed length post member to form an improved adjustable column which overcomes many of the above-mentioned deficiencies in the prior art.

According to the present invention, there is provided an adjustable load-bearing apparatus capable of being operatively disposed on the end of an elongate structural member having a substantially fixed length so as to produce a structural assembly having an adjustable length, said adjustable load-bearing apparatus comprising bearing plate means for engaging an end of said elongate structural member, and for distributing a load thereover; cross-bar means disposed on said bearing plate means; load engaging means for engaging a load to be supported; a pair of adjustment screw means fixedly attached to said load engaging means; nut means operatively engaged with respective ones of said adjustment screw means and capable of bearing on a surface of said cross-bar means; and guide sleeve means depending from said load-engaging means and capable of operatively sliding longitudinally along a portion of said elongate structural member.

The apparatus of the invention can be used as either the cap or the base of the adjustable column. When the apparatus is fitted to the top of the column, thereby forming an adjustable column cap, the load-engaging means can be formed as a substantially U-shaped member, or saddle, adapted to receive therein a beam. This same apparatus can be inverted for use as an adjustable column base, in which case a short length of wood (or other suitable material) can be placed in the saddle so as to provide a secure footing for the column. On the other hand, when the apparatus of the invention is to be fitted to the bottom of the column, the load engaging means can be formed as a substantially flat plate, thereby providing a secure footing for the column without the use of additional blocking in the saddle.

The sleeve is adapted to slide along the end of the column, and provides moment-coupling between the load-engaging means and the column. By this means, rotation of the load-engaging means due to off-centre loading can be substantially prevented, without subjecting the adjusting screws to bending stresses. This ensures smoother adjusting action of the screws and nuts, and also increases the life of the apparatus.

The apparatus of the invention can be adapted to fit onto the ends of columns made of commonly available construction materials. For example, in a preferred embodiment the bearing plate and sleeve are sized to operatively engage a 6 inch×6 inch wood post. Using the apparatus of the invention, in conjunction with wood posts of this size, allows the user to readily construct high loading capacity adjustable posts and columns, to virtually any desired height using readily available materials. Of course the apparatus of the invention can be sized to accommodate columns having different dimensions, for example a 4 inch×4 inch wood post, a common pipe section, or a concrete post or column.

Assembly of an adjustable column or post using the apparatus of the invention requires little more than cutting (or forming, in the case of a concrete post) the post to the desired length, and then sliding the sleeve over the end of the post until the bearing plate bears against the end of the post. There is no need to bore holes into the end of the post, and special tools are not required. Furthermore, when the apparatus of the invention is adapted to be used with a circular pipe, spacer elements within the pipe are not required, thus simplifying installation and eliminating unnecessary expense.

An adjustable column or post using the apparatus of the invention may permanently installed, where it may be desired to provide adjustments from time to time, for example to compensate for settling of a structure. Alternatively, a column using the apparatus of the invention, may be set up on a temporary basis, for example to support scaffolding or form-work on a construction site. The apparatus of the invention is ideally suited to this type of application, because the column can be quickly assembled and disassembled as desired, thereby facilitating separate transport of the apparatus and posts (which reduces transportation costs, and damage incurred during transport), and the rapid assembly of adjustable supports of the desired height wherever they are needed.

BRIEF DESCRIPTION OF THE DRAWINGS

Further objects, features and advantages of the invention will become apparent from the following description of a preferred embodiment when read in conjunction with the accompanying drawings, in which.

DETAILED DESCRIPTION OF THE PREFERRED EMBODIMENTS

Figure 1:
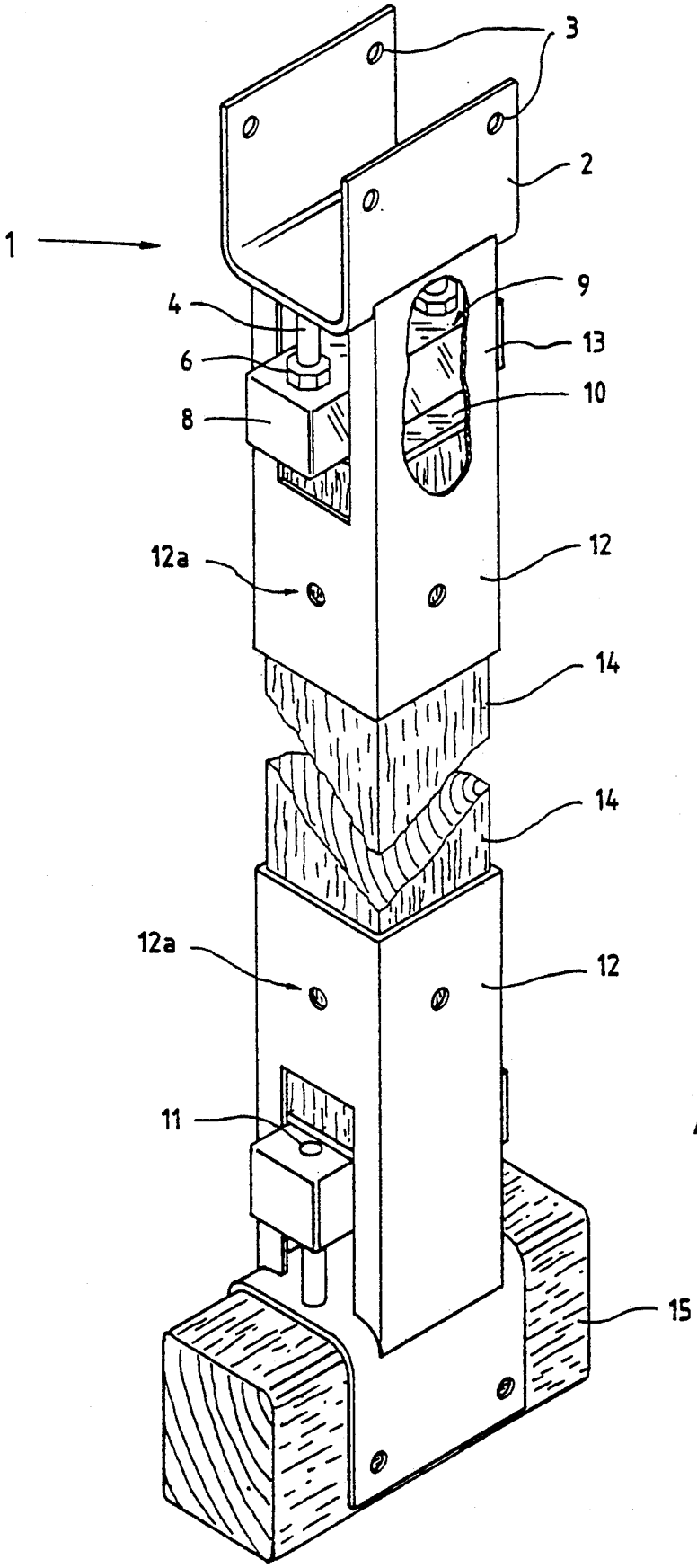
FIG. 1 is a perspective view in which an embodiment of the invention is illustrated on both the top and bottom of a column.

FIG. 1 illustrates an embodiment of the present invention fitted to both the top and bottom of a column. It will be readily apparent, however, that the invention can be fitted to either the top or bottom of a column (or indeed both, as illustrated in the figures) as desired.

Referring now to FIG. 1, according to the invention the adjustable apparatus 1 comprises a generally U-shaped load-engaging member, or saddle 2, adjusting screws 4 and nuts 6, a cross-bar 8 and bearing plate 10, and a guide sleeve 12. The adjusting screws 4 are affixed to the saddle 2 by appropriate means, for example welding. The guide sleeve 12 is fixedly adapted to the saddle 2 by means of extensions 13. The saddle 2, cross-bar 8, bearing plate 10, guide sleeve 12 and extensions 13, may be composed of steel suitably shaped and fastened together by suitable conventional means. The adjusting screws 4 can be composed of conventional threaded rod, sized appropriately according to the compressive load to which the apparatus is to be subjected. Similarly, the nuts 6 can be conventional nuts sized according to the dimensions and loading of the adjusting screws 4.

The cross-bar 8 comprises an upper bearing surface 9, on which the nuts 6 bear. Holes 11 are disposed within the cross-bar to freely allow passage therethrough of the adjusting screws 4. The bearing plate 10 may be fixedly attached to the cross-bar 8. Additionally, the saddle 2 may be adapted, by means of holes 3, to facilitate affixing the saddle to a load beam (i.e. a beam carrying a load, such as a floor or a ceiling, not shown in the figures) so as to securely retain the beam within the saddle 2. Finally, the sleave can be adapted, by means of holes 12*a*, to facilitate affixing the sleave to a post, thus permitting the adjustable apparatus 1 to resist tensile loads such as may be encountered when, for example, a normally downward load structure is subjected to uplift forces (for example, due to high winds).

As illustrated in FIG. 1, when used as a column cap, the sleeve 12 is passed over the end of a post 14 until the bearing plate 10 bears against the end of the post 14. At this point the column can be placed under a load beam, with the saddle 2 in supporting engagement with the beam. The adjusting screws 4 can then be extended, by turning the nuts 6, so as to increase the load carried by the column and/or raise the load beam.

Once the column has been placed and adjusted, nails, screws, or other suitable fastening means can be used to affix the saddle onto the post 14.

It will be seen that with the arrangement of the present invention, a compressive vertical load is transferred from the saddle 2, through the adjusting screws 4 and nuts 6, and into the cross-bar 8. From the cross-bar 8, the load is transferred through the bearing plate 10 and into the post 14. Bending moments resulting from off-centre loading are transferred directly from the saddle 2, through the extensions 13 and into the guide sleeve 12. The guide sleeve 12 then transfers the bending moments into the post 14.

It will be further seen that, when suitable fastening means are engaged with a load beam through the holes 3 in the saddle 2, and when suitable fastening means are engaged with the post 14 through the holes 12*a* in the sleeve 12, then a tensile load may be transmitted from the load beam to the post 14 via the saddle 2, extensions 13, and saddle 12.

It will be apparent that the adjusting screws 4 and nuts 6 are not subjected to significant bending moments. For this reason, the adjusting screws 4 and nuts 6 can be of smaller diameter than would otherwise be required, thereby reducing the weight and cost of the apparatus, and rendering adjustment of the column easier and more convenient.

FIG. 1 also illustrates the apparatus of the present invention fitted onto the bottom of a column, so as to provide an adjustable column base. In this case, the assembly and functioning of the various parts is the same as that described above for a column cap, with the exception that the apparatus is now inverted. Thus vertical loads are transferred from the post 14, through the bearing plate 10 and cross-bar 8, and thence through the nuts 6, adjusting screws 4 and into the saddle 2. A short length of a suitable material 15 (for example, wood) can be placed in the saddle as illustrated to provide a secure footing for the column. Similarly, bending moments are transmitted from the post 14, through the guide sleeve 12, the extensions 13, and thence into the saddle 2. Once again, it will be seen that the adjusting screws 4 and nuts 6 are not subjected to bending stresses.

Figure 2:
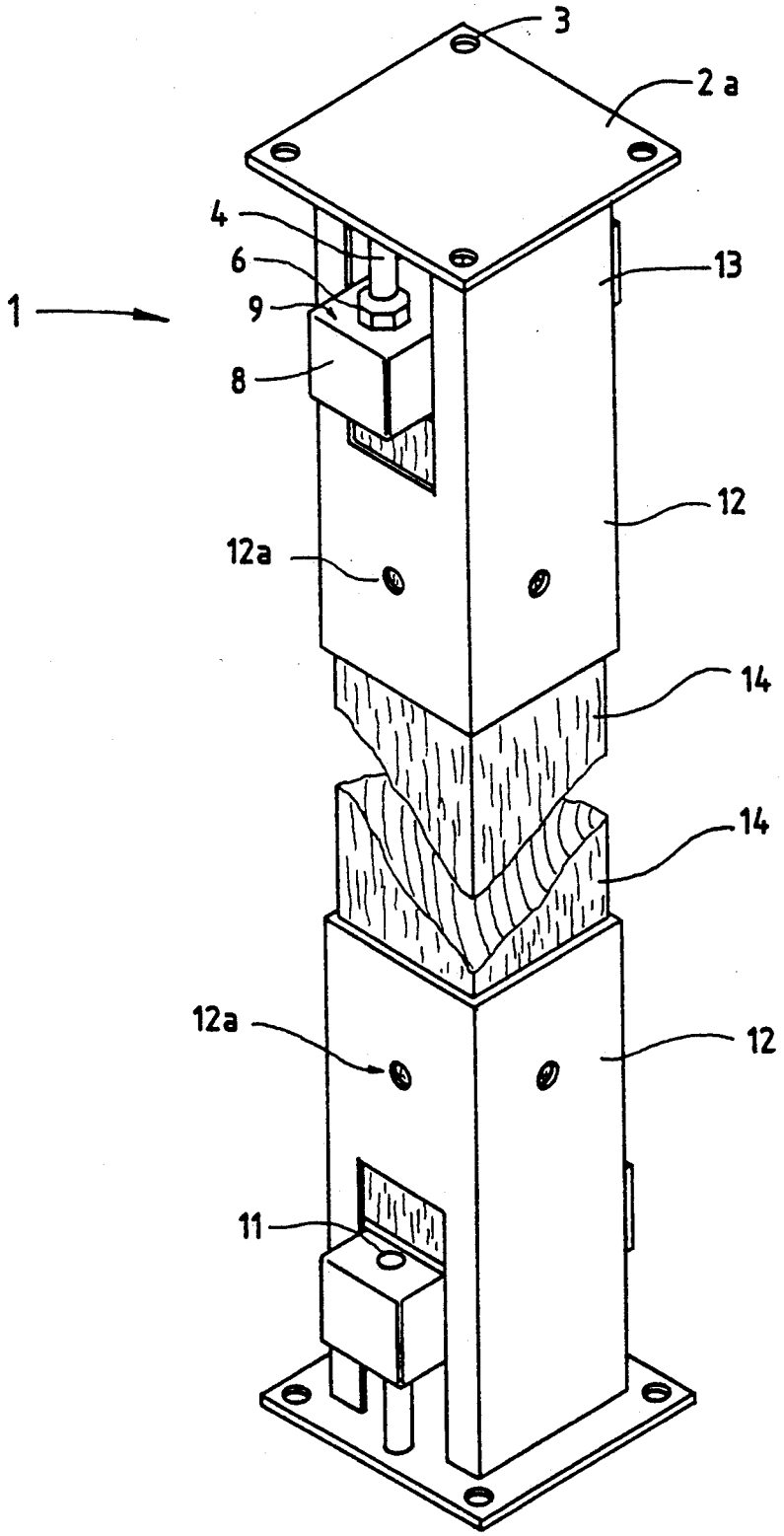
FIG. 2 is a perspective view illustrating an alternative embodiment of the invention.

FIG. 2 illustrates an alternative embodiment of the invention, in which the U-shaped saddle 2 has been replaced by a substantially flat load-engaging plate 2*b*. This alternative may be used advantageously as an adjustable column cap in cases where the load to be supported is not carried by a load beam, or as an adjustable column base where it is desired not to use an additional piece of wood to provide a footing for the column.

It will be apparent that the apparatus of the present invention can be readily employed to form adjustable columns or posts of virtually any desired height, simply by cutting the post 14 to an appropriate length. Similarly, the apparatus can be fitted to the top or bottom of the column, so that the apparatus of the invention is accessible, and adjustment of the column can be readily performed regardless of the height of the column.

It will be further apparent that the present invention is not restricted to vertical columns and posts, but may be used wherever it is desired to provide an adjustable structural member which will be subject to longitudinal (normally compressive) loading. In this context, it will be apparent that the apparatus of the invention is not restricted to use on independent posts or columns, but may in fact be fitted onto the end of any suitable elongate structural member. Such an elongate structural member may be a separate post as described above, or it may be an integral part of a larger structure.

I claim:

1. An adjustable load-bearing apparatus capable of being operatively disposed on the end of an elongate structural member having a substantially fixed length so as to produce a structural assembly having an adjustable length, said adjustable load-bearing apparatus comprising:

bearing plate means for engaging an end of said elongate structural member, and for distributing a load thereover;

cross-bar means disposed on said bearing plate means;

load engaging means for engaging a load to be supported;

a pair of adjustment screw means fixedly attached to said load engaging means;

nut means operatively engaged with respective ones of said adjustment screw means and capable of bearing on a surface of said cross-bar means; and guide sleeve means depending from said load-engaging means and capable of operatively sliding longitudinally along a portion of said elongate structural member.

2. An apparatus as claimed in claim 1, wherein said load engaging means comprises a substantially U-shaped saddle adapted to receive therein a portion of another structural member disposed substantially perpendicular to said elongate structural member.

3. An apparatus as claimed in claim 1, wherein said load engaging means comprises a generally flat plate.

4. An apparatus as claimed in claim 1, wherein said load engaging means further comprises at least one hole permitting said load engaging means to be affixed to another structural member.

5. An apparatus as claimed in claim 1, wherein said sleeve means further comprises at least one hole permitting said sleeve means to be affixed to said elongate structural member.

6. An apparatus as claimed in claim 1, wherein said cross-bar means and said bearing plate means are fixedly attached to each other.

7. An apparatus as claimed in claim 1, wherein respective ones of said adjustment screw means are spaced apart by a distance sufficient to prevent interference between said adjustment screw means and said elongate structural member.

8. An apparatus as claimed in claim 1, wherein said cross-bar means comprises apertures disposed so as to permit passage of said adjusting screw means through said cross-bar means.

9. An apparatus as claimed in claim 1, wherein said elongate structural member is composed of wood.

10. An apparatus as claimed in claim 1, wherein said elongate structural member is composed of concrete.

11. An apparatus as claimed in claim 1, wherein said elongate structural member is composed of metal.

12. An apparatus as claimed in claim 11, wherein said elongate structural member is formed as a pipe section.

* * * * *